US005390386A

United States Patent [19]

Mathey et al.

[11] Patent Number: 5,390,386

[45] Date of Patent: Feb. 21, 1995

[54] SUSPENSION BRIDGE CABLE WRAP AND APPLICATION METHOD

[75] Inventors: Stephen G. Mathey, Continental; Roy J. Lanham, Jerry City, both of Ohio; Bernard J. McMartin, Rehoboth Beach, Del.; Arnold L. Rader, Weston; Daniel H. Brown, Perrysburg, both of Ohio

[73] Assignee: The D. S. Brown Company, Inc., North Baltimore, Ohio

[21] Appl. No.: 69,701

[22] Filed: Jun. 1, 1993

[51] Int. Cl.[6] ..... E01D 11/00

[52] U.S. Cl. ..... 14/22; 156/53; 14/74

[58] Field of Search ..... 14/18, 21, 22, 74, 78; 52/223.13, 223.14, 745.21; 57/233, 235, 14; 156/86, 187, 188, 53; 174/110 AR, 110 SR, DIG. 8; 248/56

[56] References Cited

U.S. PATENT DOCUMENTS

| | | | |
|---|---|---|---|
| 3,054,710 | 9/1962 | Nixon | 156/53 X |
| 3,296,047 | 1/1967 | Parr | 156/187 X |
| 3,885,085 | 5/1975 | Bahder et al. | 174/36 |
| 3,935,685 | 2/1976 | Howlett | 52/223.13 |
| 4,151,366 | 4/1979 | Betts et al. | 174/116 |
| 4,168,192 | 9/1979 | Nyberg | 156/86 |
| 4,168,363 | 9/1979 | Boettcher | 528/48 |
| 4,313,029 | 1/1982 | Bunish | 174/115 |
| 4,633,540 | 1/1987 | Jungwirth et al. | 14/21 X |
| 4,679,600 | 7/1987 | Dougherty | 138/128 |
| 4,803,104 | 2/1989 | Peigneur et al. | 156/86 X |

FOREIGN PATENT DOCUMENTS

| | | | |
|---|---|---|---|
| 839138 | 6/1960 | United Kingdom | 156/86 |

OTHER PUBLICATIONS

Hypalon (Las Vegas Schools Choose Haartz–Mason Single–Ply Membranes) Brochure (May, 1991).

A Strong Case For Hypalon Synthetic Rubber Brochure.

Hypalon Synthetic Rubber Product Information General Guidelines for Wire and Cable Use Brochure (Oct., 1991).

Polymers For Engineering Applications (1987), (pp. 46–47).

*Primary Examiner*—Ramon S. Britts

*Assistant Examiner*—James A. Lisehora

*Attorney, Agent, or Firm*—Willian Brinks Hofer Gilson & Lione

[57] ABSTRACT

An encapsulated cable for a suspension bridge or a cable-stayed bridge, the cable (10) being encapsulated by a wrap (16) which is formed by spirally winding a flexible strand (S) of a synthetic rubber tightly therearound. The strand is wound with each wind thereof overlapping one-half the width of the preceding wind, thereby forming a uniform thickness, double layer wrap. After the spiral winding step the wrap is heated to heat seal the superimposed layers to one another to thereby seal the seam formed therebetween and shrink the wrap into tight engagement with the cable. The strand, specifically the outermost layer of a laminated multiple layer strand, is precolored with a suitable colorant to eliminate the need for after painting the wrap to obtain a suitable color match between it and adjacent portions of the bridge structure. A joint between the cable and an annular opening in a support member (14) through which it passes is sealed before the spiral wrapping step by positioning an elastomeric annular member (20) around the cable in engagement with the cable and the support member, tightly circumscribing the annular member with a synthetic rubber sleeve (26) to ensure that its engagement with the support member and the cable is sealing engagement, and then by performing the cable spiral wrapping step beginning at the support member to cover the synthetic rubber sleeve as well as the portion of the cable extending therebeyond.

20 Claims, 2 Drawing Sheets

SUSPENSION BRIDGE CABLE WRAP AND APPLICATION METHOD

BACKGROUND OF THE INVENTION

1. Field of the Invention

This invention relates to a wrap for a large, lengthy outdoor tubular article, such as a cable of a suspension bridge or cable-stayed bridge, and to a method for applying such a wrap to such an article.

2. Description of the Prior Art

Cables for suspension bridges and cable-stayed bridges are exposed to severe outdoor climatic conditions and must be painted or otherwise coated to avoid rusting and other forms of deterioration that can result from such exposure. Traditionally, such cables were painted with weather-resistant paint, but periodic repainting of painted cables is still required, at substantial expense due to the relative inaccessibility of such cables, because of the severity of the climatic conditions to which such painted cables are often exposed. Removal of paint prior to repainting, which is often necessary for proper repainting, also raises environmental concerns.

More recently, it has become known that bridge. cables can be more permanently protected from exposure by spirally wrapping them with a strand of indefinite length of a Neoprene or similar polychloroprene material. However, a material of this type usually cannot be properly precolored to match or blend in appearance with the other elements of a bridge or other structure where it is to be used. Thus, it is customary, after spirally wrapping a bridge cable with a Neoprene covering, to paint the outer surface of the wrapping to thereby ensure a suitable color match between the cable and other bridge elements. This after painting step, of course, is quite labor intensive and therefore very expensive.

Further, in spirally wrapping a suspension bridge cable with a Neoprene covering, it is important that each turn of the covering be securely bonded to the preceding turn, to properly seal the seam therebetween and thereby prevent the ingress of moisture and dust into the interface between the covering and cable. In the use of Neoprene coverings of the type described, it was known that the seam could be sealed by providing a significant overlap between the successive turns of the covering and by bonding the overlapped layers to one another by the use of a solvent. However, the application of the solvent is also labor intensive, and therefore expensive, and many solvents are objectionable on environmental and health and safety grounds, therefore requiring great care in the handling and disposal of such materials. Further, the solvent sealing step tends to disturb a previously painted surface.

SUMMARY OF THE INVENTION

According to the present invention a cable for a suspension bridge or a cable-stayed bridge or other large, lengthy outdoor tubular article may be advantageously protected from exposure to severe climatic conditions by spirally wrapping it with a flexible strand of indefinite length of a suitable synthetic rubber chlorosulfonated polyesthylene material, such as a material being sold for various uses, such as a roof covering material, under the brand name "HYPALON." Such material can be prepigmented in a wide variety of colors, thus eliminating the need for after painting that was characteristic of Neoprene coverings to obtain a proper color match between the exterior of the cover and the other elements of the bridge or adjacent structure. Further, overlapping portions of successive turns of such a synthetic rubber can be properly sealed to one another to seal the seam therebetween by a heat sealing operation, for example, by passing an annular radiant heater or an internally heated annular blanket therealong, to thereby eliminate the need for a solvent sealing step and its attendant solvent handling problems that was characteristic of Neoprene coverings.

A further advantage of a heat sealing step, as described above, is that a synthetic rubber covering material such as HYPALON brand synthetic rubber covering material can be provided with a significant degree of heat shrinkability in its longitudinal or machine direction. Thus, the temperature level that is required to seal superimposed layers or turns of such material to one another will cause such layers to contract or shrink, and thereby ensure that the bridge cable or other article is very snugly engaged by its spirally extending covering.

A HYPALON synthetic rubber strand used in the practice of the present invention preferably is a laminate of two layers of such material to provide a suitable covering thickness. When such a laminate is used, it is preferred that it is used with a reinforcing scrim or screen, such as a scrim formed from a polyester or other high tensile strength organic material, imbedded between the layers to improve the overall tensile strength of the strand. The use of such a scrim will reduce the degree of heat shrinkability of the strand, but if the strand is maintained under tension as it is applied to the cable, a scrim reinforced synthetic rubber strand will still have sufficient heat shrinkability to ensure that the cable covering will snugly engage the underlying cable.

In the practice of the present invention with respect to a suspension bridge cable, it is important to be able to properly seal the joint which is formed between the cable and each cable supporting stanchion or member, as several such stanchions or members are usually used at spaced apart locations along the length of a typical suspension bridge cable. According to a preferred embodiment of the present invention, such a seal is provided by the use of a generally wedge-shaped extrusion of a Neoprene or similar elastomeric material which is joined end to end to form an annular member snugly surrounding a portion of the cable which is immediately adjacent to the stanchion or other supporting member, with a thicker end of the annular member in snug, sealing engagement with a surface of the cable supporting stanchion. Preferably, the ends of the extrusion are adhesively joined to one another and the annular member is then preferably mechanically restrained in such configuration by circumscribing it by a high tensile strength plastic strap or band.

A relatively short sleeve of a HYPALON synthetic rubber, which is long enough to cover the entire axial length of the elastomeric annular member and a short portion of the cable extending there beyond, is formed around the cable at a location near the elastomeric annular member and in snug engagement with the cable. The synthetic rubber sleeve is then slid up the cable toward the supporting member to surround the elastomeric member which is adjacent thereto. This step inherently stretches the sleeve, thereby increasing its tension level, and it also inherently compresses the elastomeric annular member, thereby improving the seal between it and the joint formed between the annular member and the cable. The sleeve is then preferably mechanically restrained in place by circumscribing it by a high tensile strength plastic band or strap, and the spiral wrapping of the cable, as previously described, is begun, with the spiral wrapping preferably extending from the surface of the cable supporting stanchion and thereby overlying the synthetic rubber sleeve and the elastomeric member that is surrounded thereby.

Accordingly, it is an object of the present invention to provide an improved weather-resistant wrap for a large, lengthy outdoor tubular article, such as a suspension bridge cable, and to provide a method for applying such a wrap to such an article. More specifically, it is an object of the present invention to provide a properly precolored wrap of the foregoing character to such an article to eliminate the need to paint such wrap after it is in place on the article. It is also an object of the present invention to provide a multiple layer wrap of the foregoing character whose superimposed layers can be bonded to one another by heat sealing, without the use of a solvent and the material handling and disposal problems which are attendant thereto. It is also an object of the present invention to provide a multiple layer wrap of the foregoing character from a heat shrinkable, heat sealable material whose superimposed layers are heat sealed to one another and are thereby shrunk into very tight engagement with the tubular article. It is also an object of the present invention to provide a suitable seal between a tubular article supporting member and a wrapped tubular article of the foregoing character. It is also an object of the present invention to provide a method of wrapping a previously painted tubular article which does not require the prior removal of the paint, but which nonetheless does not disturb the existing paint.

For a further understanding of the present invention and the objects thereof, attention is directed to the drawing and to the following brief description thereof, to the detailed description of the preferred embodiment, and to the appended claims.

DETAILED DESCRIPTION OF THE PREFERRED EMBODIMENT

Figure 1:
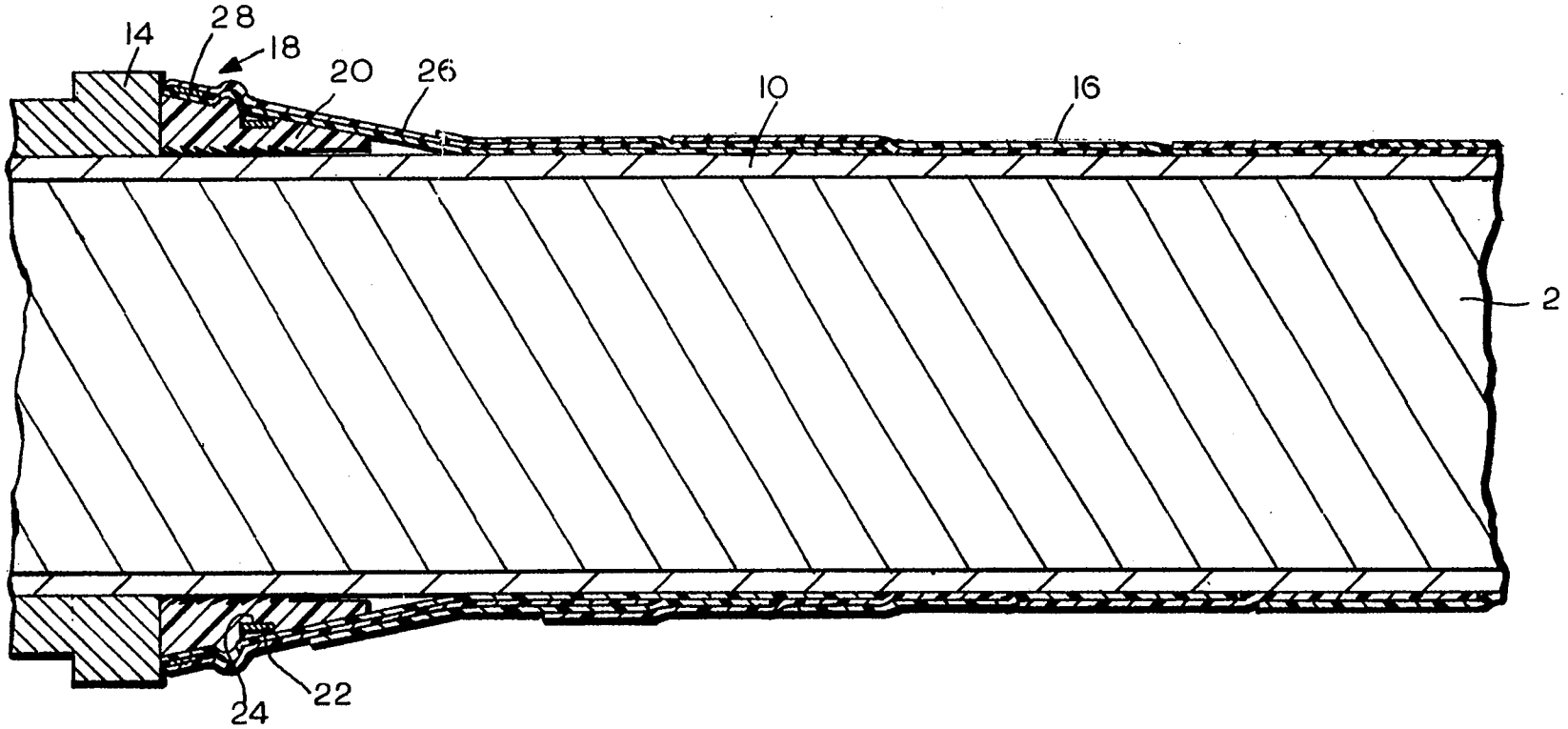
FIG. 1 is a fragmentary view, in cross-section, of a tubular article, and a tubular article supporting member, which is wrapped and sealed with respect to its supporting member in accordance with a preferred embodiment of the present invention.

FIG. 1 illustrates a section of an elongate tubular member 10, illustratively a cable of a suspension bridge or a cable-stayed bridge, which is normally used in a relatively inaccessible outdoor location and is subject to corrosion and other forms of deterioration that are likely to result from its exposure to outdoor climatic conditions. In a suspension bridge, such tubular member 10 is used to enclose and restrain the radial movement of a longitudinally extending tensile load bearing member 12, which is typically made up of an array of individual steel cables. The tubular member 10 typically is supported at various locations along its length by vertical support members, such as an annular member 14, which is fragmentarily illustrated in FIG. 1, a member which is usually referred to as a saddle or a stanchion in a suspension bridge.

While the tubular member 10 is illustrated as a unitary element, typically in a suspension bridge it will be formed by spirally wrapping a galvanized outer steel cable around the load bearing member 12, with adjacent winds of the spirally wrapped member in surface to surface contact with one another. In many older suspension bridges, the exterior of the tubular member has previously been painted, usually with a lead-based paint. Nevertheless, the wrap 16 can be applied over a painted tubular member 10, whatever the condition of its painted surface, and this can be done without disturbing the condition of the painted surface. In any case, the outer surface of the tubular member 10, whatever its construction and condition, is protected from exposure to climatic conditions by encapsulating it along its length extending from the support member 14 to the next support member, not shown, by an outer wrap 16 and by providing a seal, indicated generally by reference 18, to seal the joint formed between the support member and 14 and the tubular member 10.

Figure 3:
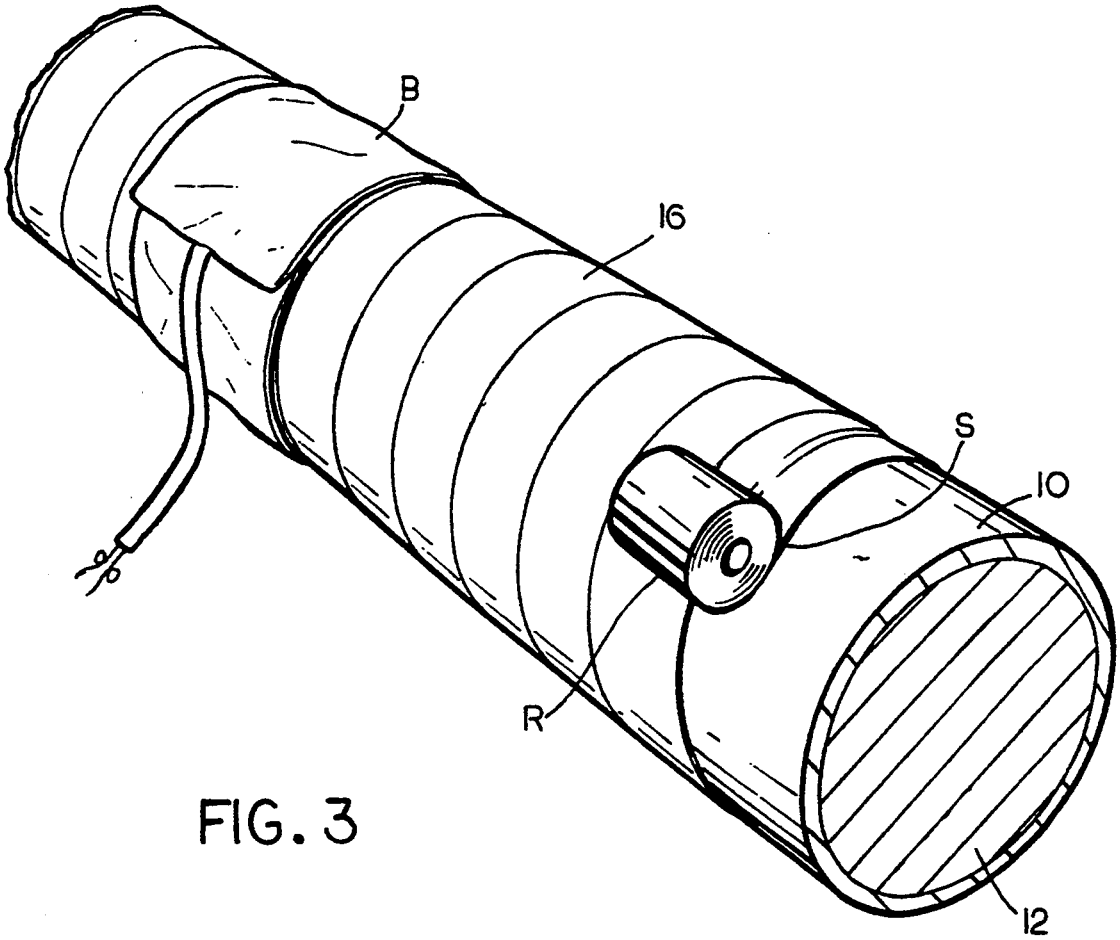
FIG. 3 is a fragmentary perspective view, at an enlarged scale, of an article which is used in the wrapped tubular article of FIG. 1.

The outer wrap 16 is formed by spirally wrapping a strand S of indefinite length from a roll or coil R thereof around the tubular member 10, as is generally indicated in FIG. 3. The strand S is a flexible organic material which is of a suitable weather resistant composition, and is preferably applied under tension to ensure that it will snugly engage the exterior of the tubular member 10. As illustrated in FIGS. 1 and 3, the strand S is applied with a substantial overlap between adjacent winds, preferably an overlap equal to one-half of the width of the strand S, to permit proper sealing of the seam formed by adjacent winds of the strand S and to provide a substantially uniform, double thickness wrap along the tubular member 10. Further, the wrap 16 serves to effectively encapsulate any lead-based paint that is already applied to the tubular member 10, thereby eliminating a potential environmental contamination problem.

Figure 2:
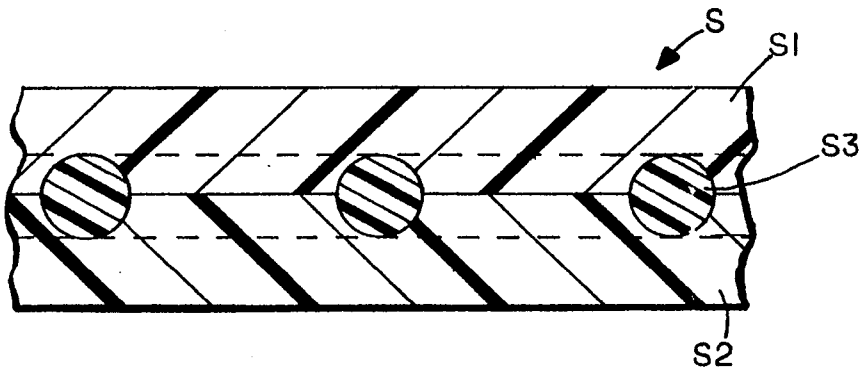
FIG. 2 is a fragmentary cross-sectional view, at an enlarged scale, of a layer of a preferred embodiment of a wrapping material used in the practice of the present invention.

The strand S is illustrated in cross-section in FIG. 2, and preferably is made up of a laminate of inner and outer layers S1 and S2 with a scrim or screen S3 of a relatively high tensile strength material imbedded therebetween. Preferably, each of the layers S1 and S2 is formed in a uniform thickness by calendaring or otherwise from a synthetic rubber material, such as that being sold by DuPont for roof covering and other uses under the brand name HYPALON. Such a material may be precolored in a wide variety of colors and shades of colors by blending a suitable amount of a proper colorant in the resin that is to be calendared. By this technique, a suitable color match can be obtained between the as calendared outermost of the layers S1 and S2 and the surrounding elements of the bridge or other adjacent structure to eliminate the need for painting the outer wrap 16 after it is in place on the tubular member 10. In an illustrated embodiment of the present invention, in which the invention is utilized to wrap a 18 inch outside diameter tubular member 10 in the form of a suspension bridge cable, the strand S is 6 inches wide, each HYPALON synthetic rubber strand S1 and S2 is 0.015 (15 mil) inch thickness, and the scrim S3 is a 250 denier 8 by 8 polyester scrim. Each wind of such material as nearly as exactly as possible overlaps one,half of the width of the preceding wind.

After the outer wrap 16 is in place on the exterior of the tubular member 10, it is heated to seal the overlapped portions of its winds to one another, to thereby seal the spirally extending seam defined by such winds. As shown in FIG. 3, this heating step may be done conductively by an internally heated electric blanket B and by progressively advancing the blanket B along the wrap 16 after it is in place on the tubular member 10. Alternatively, the heat sealing step can be performed by advancing an annular radiant heater along the wrap 16 on the tubular member 10.

Figure 4:
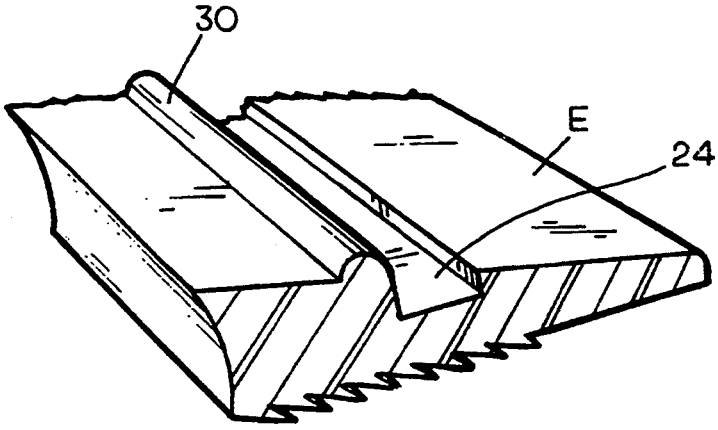
FIG. 4 is a fragmentary perspective view illustrating certain of the steps used in the forming of a wrap on an article in accordance with FIG. 1.

The seal 18 may be formed in an appropriate manner, but in the preferred embodiment of the present invention it is formed by joining opposed ends of a generally wedge-shaped Neoprene material or other elastic material extrusion E, FIG. 4, into an annular member 20. The annular member 20 snugly engages an annular portion of the outside surface of the tubular member 10, and the thicker end of the annular member 20 snugly engages an end surface of the support member 14 in an annular pattern. The opposed ends of the extrusion E are preferably adhesively joined to one another to form the annular member 20. In any case, after the annular member 20 is in place with respect to the tubular member 10 and the support member 14, it is preferably secured in such place by tightly circumscribing it with a high tensile strength plastic band or strap 22, such as a "Delrim" brand polyoxymethylene (POM) band or strap, an annular notch 24 being formed in the exterior of the annular member 20 to receive the band or strap 22.

After the annular member 20 and the band or strap 22 are in place on the tubular member 10, as heretofore described, an annular sleeve 26 is formed snugly around a portion of the tubular member 10 which is immediately beyond the annular member 20. The sleeve 26 is formed from a stretchable organic material, preferably HYPALON brand synthetic rubber, and after it is formed it is advanced toward the support member 14 to surround the annular member 20. As shown, the sleeve 26 has sufficient axial length to cover the entire axial length of the annular member 20 as well as a portion of the support member 10 which extends there beyond. In any case, the advancing of the sleeve 26 toward the support member 14 will stretch and increase the tension in the portion of the sleeve 26 which overlies the annular member 20, thereby compressing the annular member 20 into tight sealing engagement with the support member 14 and the portion of the tubular member 10 which the annular member 20 surrounds. After the sleeve 26 is in place, as described, it is preferably secured in such place by circumscribing it with a second high tensile strength plastic band or strap 28, such as a "Delrim" brand POM band or strap, an outwardly projecting annular bead 30 being formed in the exterior of the annular member 20 to axially position the band or strap 28 relative to the support member 14. Thereupon, the outer wrap 16 is formed on the tubular member 10, preferably beginning at the support member 14 and thereby serving to wrap the exterior of the sleeve 26 and cover the band or strap 28.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. In a suspension bridge or cable-stayed bridge adapted for outdoor exposure, a lengthy cable, at least one support member for supporting the cable, the cable passing through an annulus in the support member, a sealing means for sealing a joint formed between the support member and an adjacent portion of the cable and a protective wrap surrounding the sealing means and a portion of the cable extending therebeyond, said protective wrap comprising a strand of a synthetic rubber material tightly wound around the cable in a plurality of winds extending along the length of the cable, each wind of the strand overlying a portion of the preceding wind and being heat sealed thereto to seal a seam that is formed therebetween.

2. An article according to claim 1 wherein the sealing means comprises an annular sealing member formed from an elastomeric material, said annular sealing member having a surface, said surface extending generally parallel to the longitudinal axis of the cable and engaging the cable in an annular pattern, and a second surface, said second surface extending generally transversely of the longitudinal axis of the cable and engaging the support member in an annular pattern, and constricting means surrounding said annular sealing member for maintaining said annular member under compressive loading and in sealing engagement with said support member and said cable.

3. An article according to claim 2 wherein said annular sealing member comprises a double-ended, generally wedge-shaped extrusion, said extrusion being joined end to end to form said annular sealing member and having a radially thicker, support member engaging end and a radially thinner opposed end.

4. An article according to claim 3 wherein said constricting means comprises a sleeve formed from a synthetic rubber material.

5. (Amended) A method for forming a protective wrap around a substantial length of a tension load supporting cable of a suspension bridge or a cable-stayed bridge adapted for outdoor exposure comprising the steps of:

tightly spirally winding a flexible strand of a chlorosulfonated polyethylene material around a substantial length of the cable in a plurality of winds extending along said substantial length of the cable, each wind of the strand overlying a portion of the preceding wind; and heating the spirally wound strand to heat seal each wind of the strand to the underlying portion of the preceding wind to thereby seal a seam that is formed therebetween, and to thereby cross-link the chlorosulfonated polyethylene material to yield vulcanized rubber.

6. A method according to claim 5 wherein the synthetic rubber material is heat shrinkable at the heat sealing temperature which is developed during the heating step.

7. A method according to claim 6 wherein at least an outermost surface portion of the strand is formed from a chlorosulfonated polyethylene, material with a colorant added thereto to be color compatible with adjacent portions of a structure having such tubular article, said outermost surface portion being otherwise unpainted or uncolored.

8. A method according to claim 7 wherein the strand comprises inner and outer layers of a chlorosulfonated polyethylene material which are laminated to one another, and wherein the outer layer has the colorant added thereto.

9. A method according to claim 8 wherein the strand further comprises a layer of a high tensile strength scrim material embedded between the inner and outer layers.

10. A method according to claim 5 wherein at least a portion of an exterior surface of the tubular article has been painted with a lead-based paint prior to the winding of the strand of a synthetic rubber material around the tubular article, and wherein the strand of a synthetic rubber material is wound around the tubular article without removing the paint from the exterior surface of the portion thereof.

11. A method according to claim 5 in which the step of spirally winding the flexible strand is performed after the cable is in place in the bridge.

12. A method for forming a protective wrap around a lengthy tubular article adapted for outdoor exposure comprising tightly. Spirally winding a flexible strand of a synthetic rubber material around the tubular article, the strand being wound in plurality of winds extending along the length of the article, each wind of the strand overlying a portion of the preceding wind, and heating the spirally wound strand to heat seal each wind of the strand to the underlying portion of the preceding wind to thereby seal a seam that is formed therebetween, wherein the tubular article passes through an annulus of a support member that extends generally transversely of the tubular article, and further comprising, prior to winding the strand of synthetic material around the tubular article, forming an annular seal at a joint formed between the support member and the tubular article, and then winding the strand of synthetic material first around the annular seal and then around a portion of the tubular article that extends therebeyond.

13. A method according to claim 12 wherein the forming of the annular seal comprises the step of providing a double-ended extrusion having opposed ends joining the opposed ends of a double-ended extrusion of a elastomeric material end to end around the tubular article, the extrusion having a surface extending longitudinally of the tubular article that engages the tubular article in an annular pattern after the extrusion is joined end to end, the extrusion further having a second surface extending transversely of the tubular article that engages a surface of the support member in an annular pattern after the extrusion is joined end to end.

14. A method according to claim 13 wherein the forming of the annular seal comprises the further step of constricting the extrusion after it is joined end to end by surrounding it with a sleeve of a synthetic rubber material to maintain the surface in sealing engagement with the tubular article and to maintain the second surface in sealing engagement with the surface of the support member.

15. In a suspension bridge or cable-stayed bridge adapted for outdoor exposure, a lengthy tension load supporting cable and a protective wrap covering a substantial length of the lengthy cable, said protective wrap comprising a strand of a chlorosulfonated polyethylene material tightly spirally wound around the cable in a plurality of winds extending along said substantial length of the lengthy cable, each wind of the strand overlying a portion of the preceding wind and being heat sealed thereto to seal a seam that is formed therebetween, wherein said chlorosulfonated polyethylene material is a weldable thermoplastic when it is wound around the lengthy cable and is cross-linked after heat sealing to yield a vulcanized rubber coating on the lengthy cable.

16. A combination according to claim 15 wherein the strand comprises inner and outer layers of a chlorosulfonated polyethylene material which are laminated to one another, the outer layer containing a colorant therein and being otherwise unpainted or uncolored.

17. A combination according to claim 16 and further comprising a layer of high tensile strength scrim of an organic material embedded in the strand between the inner and outer layers.

18. A combination according to claim 15 wherein the strand comprises inner and outer layers of a chlorosulfonated polyethylene material which are laminated to one another and a layer of a high tensile strength scrim of an organic material embedded between the inner and outer layers.

19. A combination according to claim 18 wherein the organic material of the scrim comprises a polyester material.

20. A combination according to claim 15 wherein each wind of the strand overlies approximately one-half the width of the preceding wind, thereby forming a double thickness wrap extending along said substantial length of the lengthy cable.

* * * * *